US006881116B2

(12) United States Patent
Yoon

(10) Patent No.: US 6,881,116 B2
(45) Date of Patent: Apr. 19, 2005

(54) METHOD FOR SEALING AND FABRICATING CAP FOR FIELD EMISSION DISPLAY

(75) Inventor: Sang-Jo Yoon, Anyang (KR)

(73) Assignee: LG Electronics Inc., Seoul (KR)

( * ) Notice: Subject to any disclaimer, the term of this patent is extended or adjusted under 35 U.S.C. 154(b) by 190 days.

(21) Appl. No.: 10/352,094

(22) Filed: Jan. 28, 2003

(65) Prior Publication Data

US 2003/0143914 A1 Jul. 31, 2003

(30) Foreign Application Priority Data

Jan. 31, 2002 (KR) ..... 10-2002-0005639

(51) Int. Cl.[7] ..... H01J 9/26
(52) U.S. Cl. ..... 445/24; 445/40

(58) Field of Search ..... 445/24, 25, 40–42

(56) References Cited

U.S. PATENT DOCUMENTS 5,964,630 A * 10/1999 Slusarczuk et al. ..... 445/25

* cited by examiner

*Primary Examiner*—Joseph Williams
(74) *Attorney, Agent, or Firm*—Fleshner & Kim LLP

(57) ABSTRACT

A method for sealing and fabricating a cap in an FED is provided which is able to seal a cap in a vacuum space. The method includes fabricating a cap on which sealant is applied, locating the cap with the sealant on a substrate of a panel on which a hole is formed in a vacuum chamber, and hardening the sealant by irradiating laser onto the sealant, in order to prevent oxygen from inducing into the panel, and to prevent electrodes formed on the panel from being contaminated.

20 Claims, 9 Drawing Sheets

METHOD FOR SEALING AND FABRICATING CAP FOR FIELD EMISSION DISPLAY

BACKGROUND OF THE INVENTION

1. Field of the Invention

The present invention relates to a field emission display (FED), and particularly, to a method for sealing a cap and a method for fabricating the cap in a vacuumed space.

2. Description of the Related Art

Recently, interests and importance of display is increased as multimedia is developed. For example, a display having smaller weight, volume and power consumption is required in an environment where the mobility is an important feature such as portable information devices, and a display having larger screen and angular field is required when the display is used as a media for transmitting information to the masses. Therefore, in order to satisfy the above requires, light and thin flat panel display should be developed. Cathode ray tube (CRT) which is mainly used as the display device presently has superior function, however, volume and weight are increased as the screen is increased, and has some problems such as high voltage and high power consumption.

Therefore, there are flat panel displays such as liquid crystal display (LCD), plasma display panel (PDP), electroluminescence (EL) and field emission display (FED) for solving above problems.

Especially, the FED is a triode like the conventional CRT, however, the FED uses an acute cathode, not using a hot cathode. That is, a cold cathode, which emits electrons by quantum mechanical tunnel effect after concentrating high electric field on an emitter, is used.

Therefore, the electron emitted from the emitter is accelerated by voltage applied between the anode and the cathode, and crashed onto a phosphor formed on the anode to radiate the phosphor. Therefore, the FED has a relatively simple electrode structure, and can be operated with high speed by using phosphor radiation due to electron beam, and has advantages such as full-color, full-grayscale, high brightness and high videorate.

FIG. 1 is a perspective view showing a conventional FED.

FIG. 2 is a cross-sectional view showing the conventional FED.

As shown in FIGS. 1 and 2, the conventional FED comprises an upper glass substrate 2 and a lower glass substrate 8, a spacer 40 for supporting vacuum space between the upper and lower glass substrates 2 and 8, and a field emission array 32 formed on the lower glass substrate 8.

The field emission array 32 comprises a cathode electrode 10 and a resistance layer 12 formed on the lower glass substrate 8, a gate insulating layer 14 and an emitter 22 for emitting electrons formed on upper part of the resistance layer 12, and a gate electrode 16 formed on the gate insulating layer 14.

The cathode electrode 10 supplies electric current to the emitter 22, and the resistance layer 12 restricts overcurrent applied from the cathode electrode 10 toward the emitter 22 to supply even electric current to the emitter 22.

The gate insulating layer 14 insulates between the cathode electrode 10 and the gate electrode 16. The gate electrode 16 is used as a fetch electrode for drawing electrons. The spacer 40 supports the upper and lower glass substrates 2 and 8 so as to maintain highly vacuumed status between the upper and lower glass substrates 2 and 8.

In order to display an image, cathode voltage of negative polarity (−) is applied to the cathode electrode 10, and anode voltage of positive polarity (+) is applied to the anode electrode 4. Therefore, when sufficient electric voltages are applied to the cathode electrode 10 and the gate electrode 16, a strong electric field is generated, and electrons 30 are emitted from a tip of the emitter 22 due to the generated electric field in quantum mechanical tunneling effect. Then, the emitted electrons 30 pass a hall of the gate electrode, and crashed onto phosphors of red, green and blue colors to excite the phosphors 6. At that time, visible ray of one of the red, green and blue colors is radiated according to the phosphor 6.

FIG. 3 is a cross-sectional view showing a conventional FED on which a focusing electrode is formed.

As shown therein, a focusing electrode 20 is formed on the gate electrode 16 for focusing the electrons 30 emitted from the emitter 22. The focusing electrode focuses the electrons 30 by being applied focusing voltage of negative polarity (−). Also, a focusing insulating layer 18 is formed between the focusing electrode 20 and the gate electrode 16.

As described above, the conventional FED requires highly vacuumed status in the panel greater than $10^{-6}$ Torr due to the operational properties. For example, a distance about sub-micron is maintained between the gate electrode 16 and the emitter 22 and high electric field of $10^7$V/cm is applied therebetween. If the highly vacuumed status is not maintained between the upper and lower glass substrates 2 and 8, the insulation between the gate electrode 16 and the emitter 22 may be broken. That is, neutral particles in the panel are crashed into the electron beam and positive ions are generated. The positive ions are sputtered on the tip of the emitter 22 to degrade the device. Also, the electrons 30 crashed with the neutral particles lose their energies, and therefore, the electrons 30 can not sufficiently excite the phosphor 6, and thereby to lower the brightness.

Packaging processes of the conventional FED according to above structure will be described as follows.

FIG. 4 is a flow chart showing processing orders of vacuum packaging the conventional FED using a vacuum pump in atmosphere.

FIG. 5 is an exemplary view showing process of installing a tube and process of applying sealant for the conventional FED.

As shown in FIGS. 4 and 5, in the tube installing process, a frit glass is applied on the lower glass substrate 8 as a first sealant 52, and after that, a tube 50 is installed (ST2). At that time, the tube 50 is installed on a hall 51 of the lower glass substrate 8.

After that, a spacer 40 is formed on the upper glass substrate 2, and the frit glass is dispensed and dried around the spacer as a second sealant 54 (ST4). Herein, the second sealant 54 is installed to be higher than the spacer 40 as much as a predetermined distance (H1; usually 1 mm~2 mm), because the height of the frit glass is reduced about 30~40% in preform sintering.

After the second sealant 54 is dispensed on the glass substrate 2, the second sealant 54 is pre-sintered (ST6).

FIG. 6 is an exemplary view showing a process of preform sintering the sealant conventionally.

The preform sintering process has different sintering temperature curves according to frit materials in order to completely burn out a binder of organic material included in the frit glass. Generally, in the above preform sintering process, a standard process is to hold the second sealant 54 for 30 minutes~1 hour at about 300° C. temperature. After the second sealant 54 is preform sintered, the upper glass substrate 2 and the lower glass substrate 8 are compressed and aligned to adhere the substrates.

After that, the upper and lower glass substrates 2 and 8 are moved to a heating chamber to sinter the first and second sealant 52 and 54 (ST6).

FIG. 7 is an exemplary view showing a sealant sintering process in the conventional art.

As shown therein, the sintering process is performed at the temperature of 400° C.~450° C. which is higher than that of the preform sintering after moving the panel into the heating chamber 70. At that time, when the sintering process is performed under atmosphere environment, the cathode electrode 10, the gate insulating layer 14, the gate electrode 16, the emitter 22, the focusing insulation layer 18 and the focusing electrode 20, which emit the electrons in the FED, may be damaged by reacting with oxygen or carbon in the atmosphere. Especially, the metal material such as the emitter 22 can be oxidated easily, and therefore, the luminous characteristic is lowered greatly.

In order to prevent the damage as above, inert gas 58 such as nitrogen and/or argon is supplied into the panel using a tube 56 extended from the heating chamber 70, and therefore, devices of the field emitting array are not reacted with the oxygen.

On the other hand, FIG. 8 is an exemplary view showing sealant sintering process according to the conventional art.

As shown therein, a gas inlet port 60 is formed on a lower end portion of the heating chamber 70 and a gas outlet port 62 is formed on an upper end portion of the heating chamber 70 to flow the inert gas such as the nitrogen and/or the argon into the entire heating chamber 70, and therefore, the materials for emitting the electrons can not be reacted with the oxygen in a high temperature process. Herein, the inducing of the inert gas is made by opening the inlet port for 10~20 minutes in the state that a valve out of the outlet port is closed to make the inside of heating chamber 70 be the nitrogen and/or argon inert gas atmosphere, and after that, the outer valve is opened to flow the gas continuously.

Under above atmosphere, when the temperature of the panel is maintained as 400~450° C. temperature for 30 minutes~1 hour, the first and the second sealants are sintered and the panel sealing is completed. The above conventional sintering method is defined as a atmosphere sealing method. At that time, the height of the second sealant 54 is extracted during the sintering process, and therefore, the height of the frit glass is coincided with that of the spacer 40.

FIG. 9 is an exemplary view showing a getter inserted into the conventional tube.

FIG. 10 is an exemplary view showing a cutting process of the conventional tube.

As shown in FIGS. 9 and 10, after the upper glass substrate 9 and the lower glass substrate 8 are attached, a getter 66 is inserted into the panel through the tube 50 and the pumping process is performed (ST8). That is, as the panel, on which the upper glass substrate 2n and the lower glass substrate 8 are attached, is heated in the heating chamber 70, and at the same time, the inside of the panel is pumped by a vacuum pump 72. Therefore, when the inside of the panel reaches to a desired vacuumed degree, middle portion of the tube 50 is heated by a local heating device 68 to cut off the tube 50, and therefore, the panel is separated from the heating chamber 70.

On the other hand, in a pinch-off process for cutting off the tube 50, the tube 50 which is exposed in atmosphere is cut, and therefore, the vacuumed degree of the panel is lowered. In order to increase the vacuumed degree of the panel having lowered vacuumed degree, high temperature is compressed to the getter 66 located in the panel to activate the getter 66 (S12). When the getter 66 is activated, the vacuumed degree of the panel is increased more than a predetermined level, and therefore, the final panel is completed.

However, the pinch-off process of the FED as described above is performed under the atmosphere, the oxygen is induced through the hole 51. Accordingly, when the oxygen is induced into the panel, the metal material such as the emitter is easily oxidated, and thereby, the life span of the FED is reduced and the luminous characteristic is lowered greatly. Also, color purities are different from respective points due to the oxygen in displaying. Also, since the conventional panel sealing method is performed at high temperature, it takes a lot of times to process. Also, in the process of installing the tube, the tube is attached on the lower glass substrate 8 by the first sealant 52. At that time, the electrodes formed on the lower glass substrate 8 may be contaminated by the organic binder of the first sealant 52.

SUMMARY OF THE INVENTION

Therefore, an object of the present invention is to provide a method for sealing a cap in a field emission display (FED) which is able to prevent oxygen from being induced into a panel by sealing a cap in a vacuumed space.

Another object of the present invention is to provide a method for fabricating a cap of an FED which is able to prevent electrodes formed on a panel from being contaminated by removing an organic binder included in a sealant applied on a cap through a sintering process when the cap is fabricated.

To achieve the objects of the present invention, as embodied and broadly described herein, there is provided a method for sealing a cap in an FED comprising: a step of locating a cap, on which a sealant is applied, on a substrate of a panel on which a hole is formed in a vacuum chamber; and a step of hardening the sealant by irradiating laser in order to cover the hole.

Also, to achieve the objects of the present invention, there is provided a method for fabricating a cap in an FED comprising: a step of applying a sealant on a substrate of glass material; a step of sintering the glass substrate on which the sealant is applied; and a step of cutting the glass substrate on which the sealant is applied.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
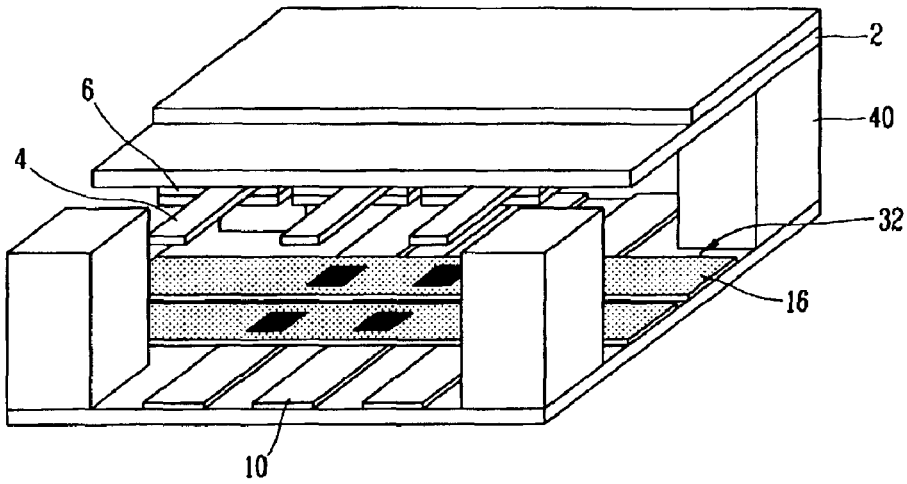
FIG. 1 RELATED ART
FIG. 1 is a perspective view showing a conventional field emission display (FED) device.
Figure 2:
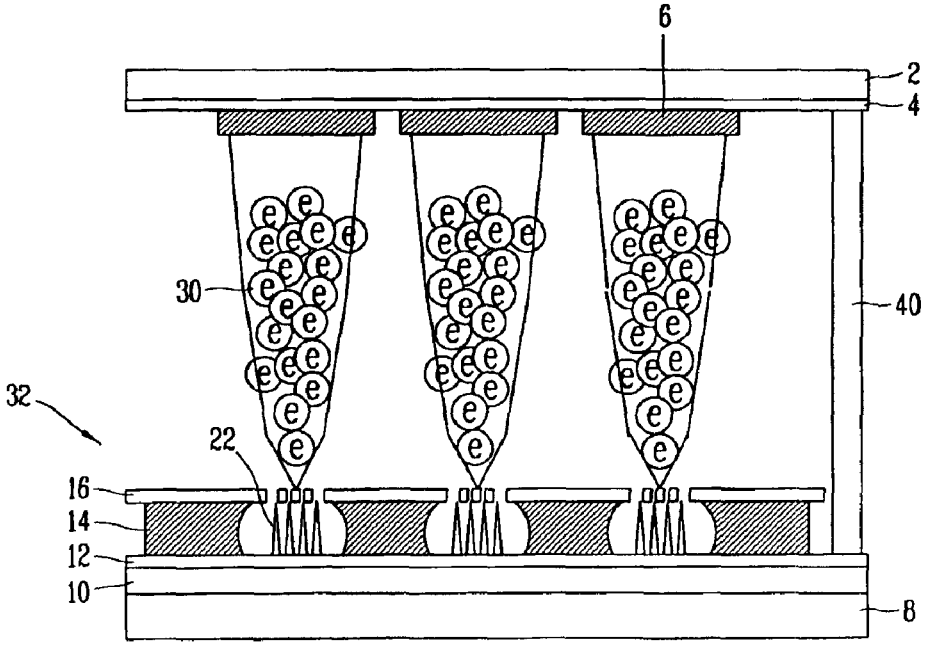
FIG. 2 RELATED ART
FIG. 2 is a cross-sectional view showing the conventional FED.
Figure 3:
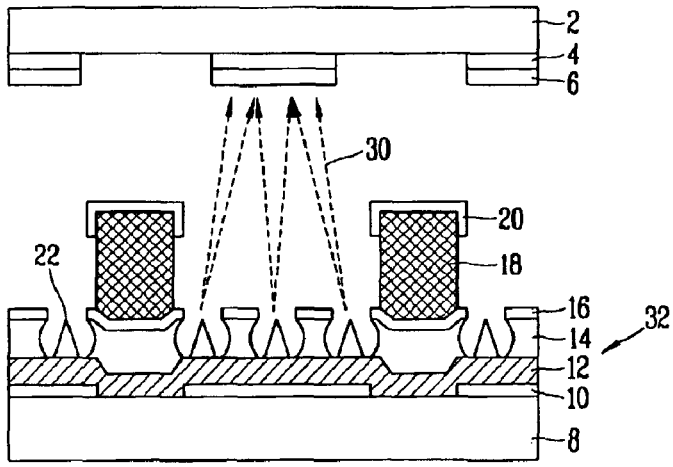
FIG. 3 RELATED ART
FIG. 3 is a cross-sectional view showing a conventional FED on which a focusing electrode is formed.
Figure 4:
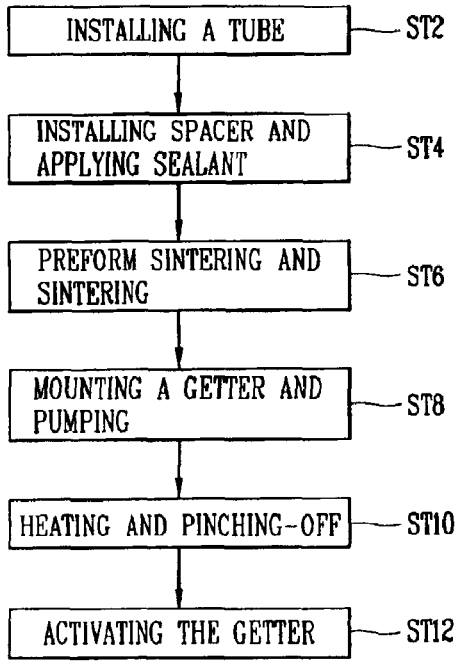
FIG. 4 RELATED ART
FIG. 4 is a flow chart illustrating process orders of vacuum packaging for the conventional FED using a vacuum pump in atmosphere.
Figure 5:
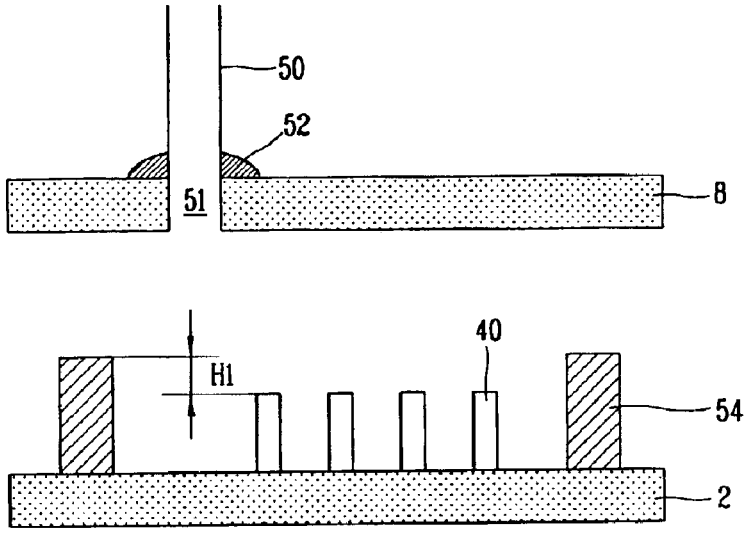
FIG. 5 RELATED ART
FIG. 5 is an exemplary view showing a process of installing tube and a process of applying sealant for the conventional FED.
Figure 6:
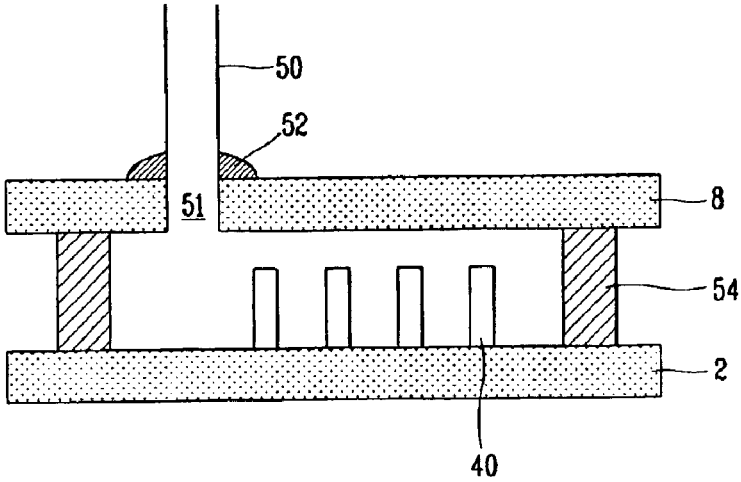
FIG. 6 RELATED ART
FIG. 6 is an exemplary view showing a conventional sealant preform sintering process.
Figure 7:
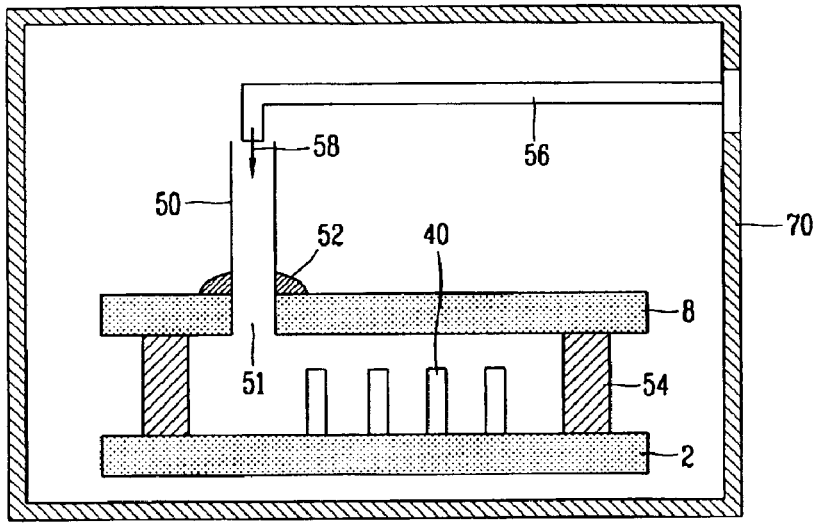
FIG. 7 RELATED ART
FIG. 7 is an exemplary view showing a conventional sealant sintering process.
Figure 8:
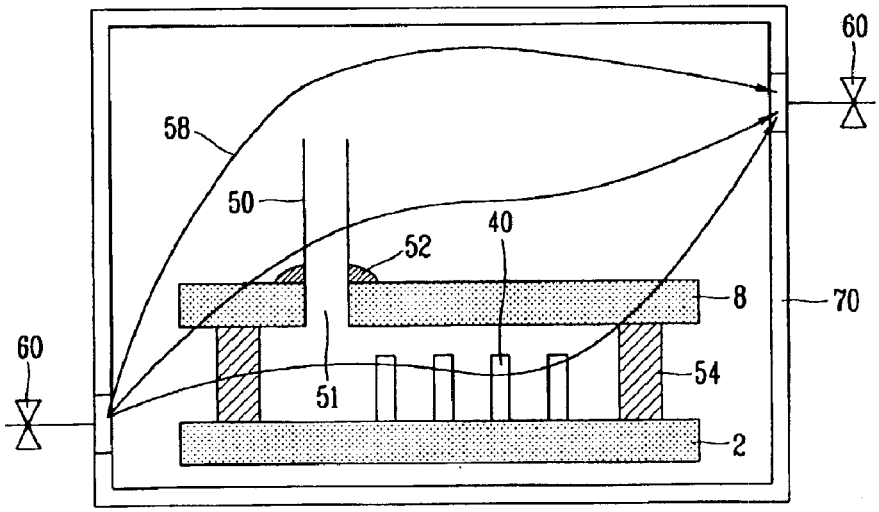
FIG. 8 RELATED ART
FIG. 8 is an another exemplary view showing a conventional sealant sintering process.
Figure 9:
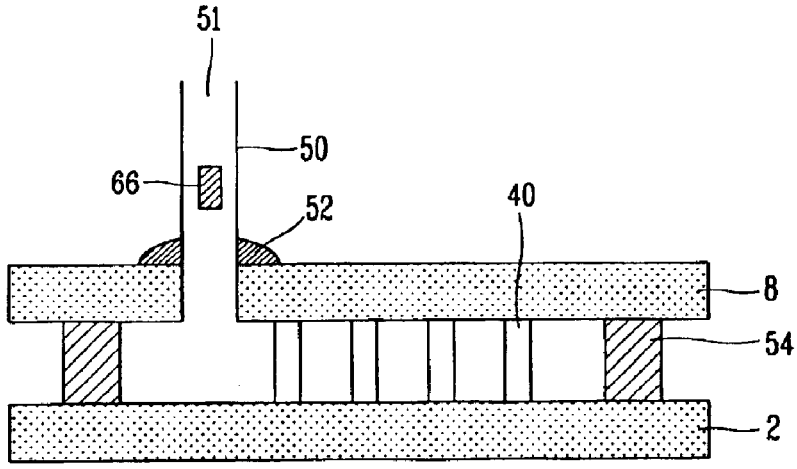
FIG. 9 RELATED ART
FIG. 9 is an exemplary view showing a getter inserted into a conventional tube.
Figure 10:
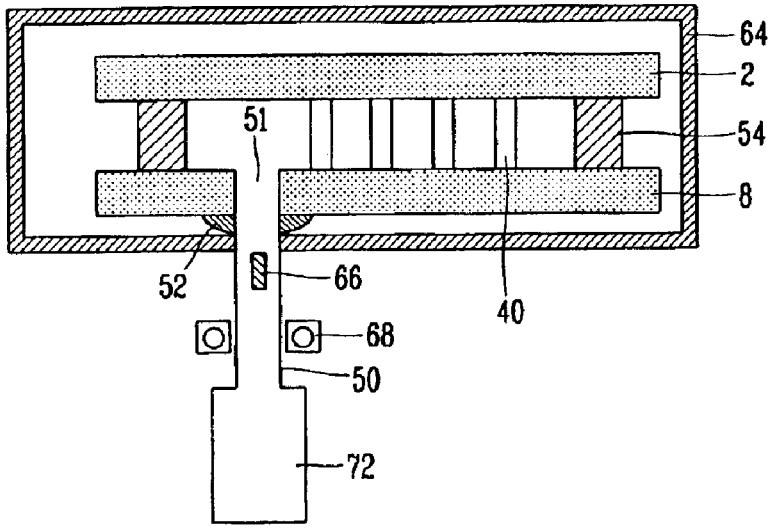
FIG. 10 RELATED ART
FIG. 10 is an exemplary view showing a processing of cutting tube.
Figure 11:
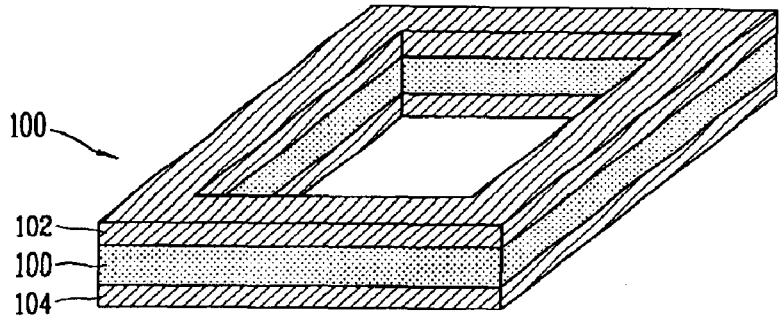
FIGS. 11 through 13 are exemplary views showing a vacuum sealing method for an FED panel according to the present invention.
Figure 12:
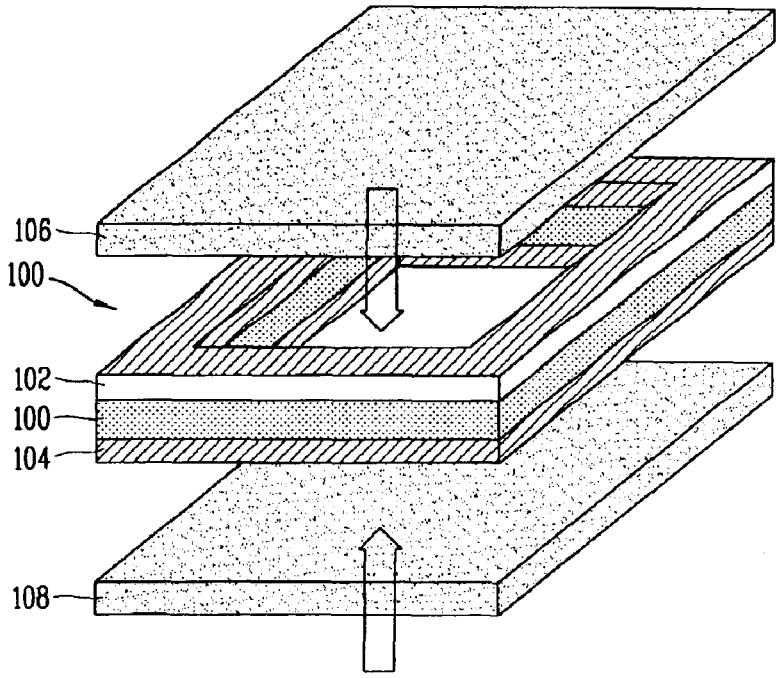
Figure 13:
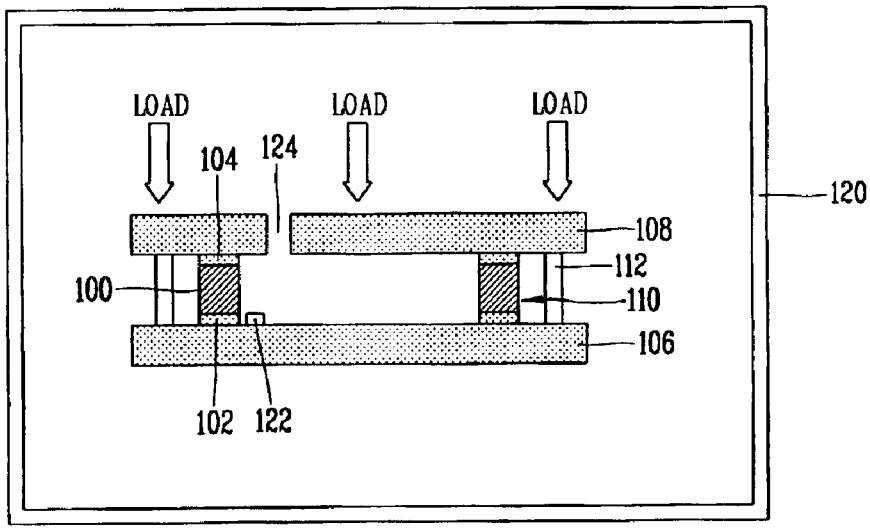

FIGS. 11 through 13 are exemplary views showing a vacuum sealing method for a field emission display (FED) panel according to the present invention.

As shown therein, a sealing application unit 110 comprises a frame 100, and a first and a second sealants 102 and 104 applied on upper/lower parts of the frame. Also, an upper glass substrate 106 and a lower glass substrate 108 are aligned as taking the sealing application unit 110 therebetween. At that time, a getter 122 for maintaining a highly vacuumed status by absorbing gas remained in a panel is inserted between the upper glass substrate 106 and the lower glass substrate 108.

The vacuum sealing method for the FED panel according to above construction will be described in detail as follows.

The frame 100 is made by a material having same thermal expansion coefficient as those of the upper and lower glass substrates 106 and 108. For example, the frame 100 can be made using glass material.

It is desirable that the first and second sealants 102 and 104 are applied in a screen printing method rather than the conventional dispensing method, because frit glass of lower viscosity flows down in dispensing since the frit glass of paste type has the viscosity.

After that, the upper glass substrate 106, the lower glass substrate 108 and the sealing application unit 110 are moved to a vacuum chamber 120.

On the other hand, a plurality of auxiliary jigs, desirably, 4 or more auxiliary jigs 112 are installed between the upper glass substrate 106 and the lower glass substrate 108. The auxiliary jigs 112 maintain a distance between the upper glass substrate 106 and the lower glass substrate 108. After that, the upper and lower glass substrates 106 and 108 are adhered by applying a predetermined load on the lower glass substrate 108. On the other hand, the above sealing method is defined as a vacuum sealing method.

Figure 14:
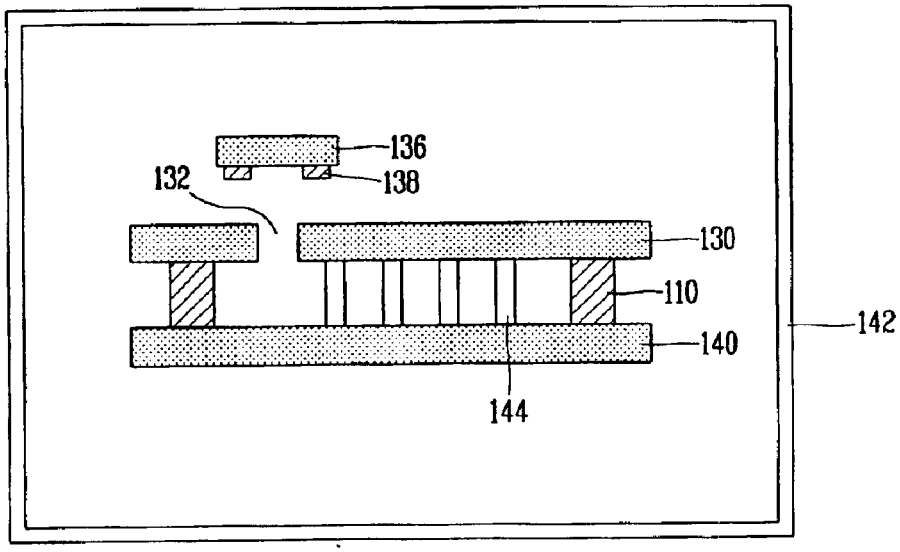
FIG. 14 is an exemplary view showing a method for sealing a cap in an FED according to an embodiment of the present invention.

FIG. 14 is an exemplary view showing a method for sealing a cap in the FED device according to an embodiment of the present invention.

As shown in FIG. 14, the FED device of the present invention undergoes cap sealing after the lower glass substrate 108 and the upper glass substrate 106 are adhered by the vacuum sealing method. That is, in the cap sealing method according to the present invention, a cap 136 of glass material is disposed, and the cap 136, on which the sealant is applied, is located on the substrate of the panel on which the hole is formed in the vacuum chamber. After that, the laser is radiated to the sealant 138 of the cap 136 to harden the sealant, in order to cover the hole.

On the other hand, as an another embodiment of the cap sealing method according to the present invention, the method of the present invention can be applied after attaching the lower glass substrate 8 and the upper glass substrate 2 by the conventional atmosphere sealing method. At that time, there is no need to install the tube 50 as in the conventional atmosphere sealing method.

The cap sealing method for the FED according to the present invention will be described more specifically.

A plurality of spacers 144 for supporting the upper glass substrate 140 and the lower glass substrate 130 are installed in the upper and lower glass substrates 140 and 130 attached by the atmosphere sealing method or by the vacuum sealing method. Also, the sealing application unit 110 is installed to attach the upper and lower glass substrate 140 and 130.

After that, the attached upper and lower glass substrates 140 and 130 (hereinafter, referred to as "panel") is moved to the vacuum chamber 142. The vacuum chamber is exhausted to be vacuumed status of a predetermined Torr (desirably, $10^{-7}$ Torr) by a vacuum pump which is not shown, after the panel is moved therein. At that time, the inside of the panel is also exhausted to be the vacuumed status.

After that, the cap 136 is aligned so as to cover the hole 132 of the lower glass substrate. That is, when the cap 136 is located on the hole 132 of the lower glass substrate by a robot arm (not shown) in the panel of vacuum status, the hole 132 of the lower glass substrate and the cap 136 are attached by the sealant of the cap.

Figure 15A:
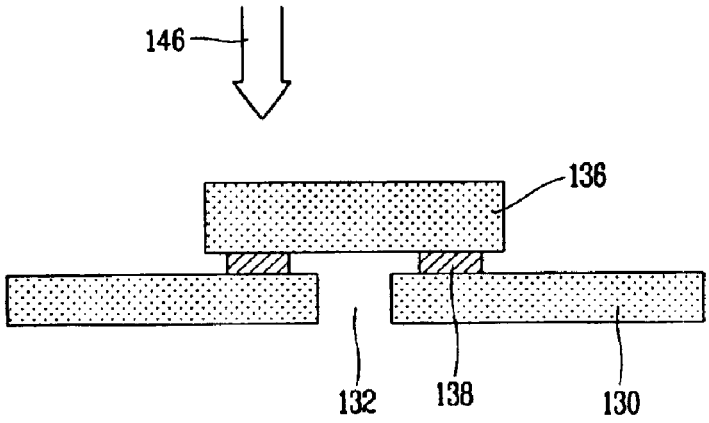
FIGS. 15A and 15B are exemplary views showing laser radiated onto a sealant of the cap.
Figure 15B:
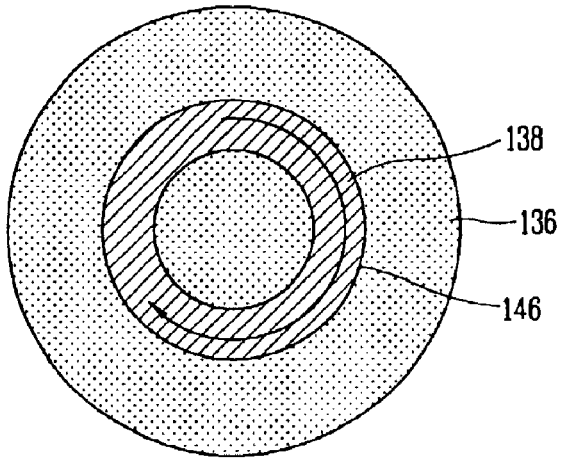

FIGS. 15A and 15B are exemplary views showing radiation of the laser onto the sealant of the cap.

As shown in therein, when the laser is radiated onto the sealant 138 of the cap 136, the sealant 138 is hardened and the cap 136 is attached on the lower glass substrate 130.

For example, since the sealant 138 applied on the cap 136 surrounds the cap 136 as a circular shape, the laser 146 is irradiated on the sealant 138 as making a concentric circle. At that time, if a diameter of the sealant 138 applied on the cap 136 is small, most of the sealant is melted when the center part of the sealant is sintered. On the contrary, if the diameter of the sealant 138 applied on the cap 136, the laser 146 is irradiated onto the sealant 138 once more to attach the cap 136 on the lower glass substrate 130 completely. At that time, in order to prevent the cap 136 or the upper and lower glass substrates 140 and 130 from being damaged by local high temperature energy of the laser 146, 200~350° C. reference temperature is made. Accordingly, the damages of the devices due to the oxidation or other thermal processes in sintering for the cap sealing can be minimized, and also, the processing time can be reduced as much as the difference of sintering temperature.

Figure 16:
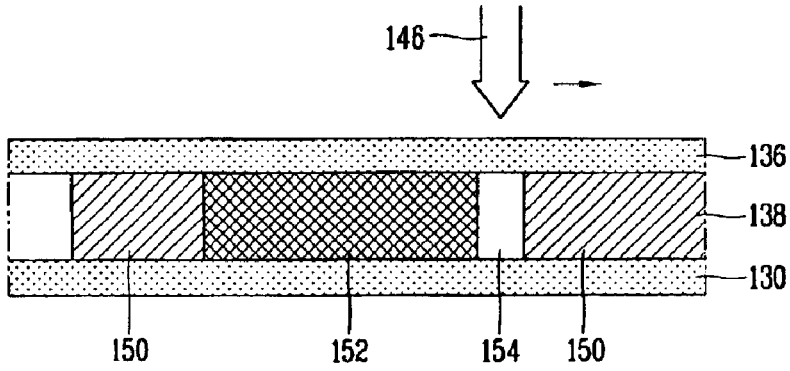
FIG. 16 is an exemplary view showing hardening process of the sealant when the laser is radiated between the sealant of the cap and a lower substrate according to the present invention.

FIG. 16 is an exemplary view showing a process of hardening the sealant when the laser is radiated between the sealant and the lower substrate according to the present invention.

As shown therein, a first sealant portion 152 from the point where the laser is radiated at first to the present point is a part that is solidificated after melted by the energy, and a second sealant portion 154 on which the laser 146 is located is under process of melting. In addition, a third sealant portion 150 besides the above portions is under pre-sintered status which is not yet sintered by the laser 146. Herein, the first sealant portion 152 is melted in a state that the height is maintained as it is, and solidificated, and therefore, the first sealant portion 152 maintains same height as that of the third sealant portion 150 which is in preform-sintered status. In addition, even though the second sealant portion 154 is under the process of laser irradiation, the height of the second sealant portion 154 is not affected because the first and third sealant portions support the second sealant portion 154.

However, if the laser irradiation speed is high, the first sealant portion 152 on which the laser is irradiated may be distributed widely,iated may be distributed widely,ction may be generated. At that time, the laser 146 is irradiated as compressing the upper part of the cap 136 with a predetermined pressure by using a gap reference frame, and thereby, the height change of the cap 136 can be prevented.

Figure 17:
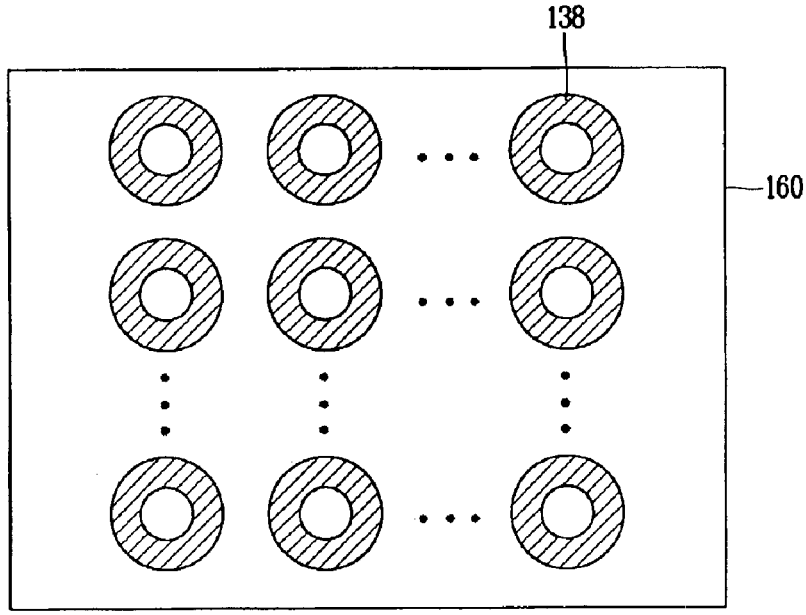
FIG. 17 is a view illustrating a method for fabricating the cap in the FED according to the embodiment of the present invention.

FIG. 17 is a view showing a method for fabricating the cap in the FED device according to an embodiment of the present invention.

Referring to FIG. 17, a substrate 160 of glass material is disposed. The substrate 160 of glass substrate is the same material as those of the upper glass substrate 140 and the lower glass substrate 130.

After that, a lot of sealant 138 is applied on the glass substrate 160 using a screen printing method as a circular shape. At that time, a center of circular sealant 138 is empty so that the sealant 138 is not overlapped with the hole 132. Also, the sealant 138 of the cap is printed to be a few $\mu$m~hundreds of $\mu$m thickness so as to absorb incident energy of the laser 146 easily and to maintain the vacuumed state in the panel. Also, the frit glass is used as the sealant, and the frit glass is formed by mixing glass powder and binder with more than 10:1 mass ratio.

After the sealant 138 is printed on the glass substrate 160, the glass substrate 160 is sintered under 300~400° C. At that time, the organic binder component included in the sealant 138 is completely burnt out and removed.

Finally, the glass substrate 160 is cut into predetermined sizes to complete the cap 136 on which the sealant is printed.

As described above, according to the method for sealing and fabricating the cap of the FED device of the present invention, the cap is sealed in the vacuum space to prevent the oxygen from inducing into the panel during the cap sealing process. Therefore, damages of the devices due to the oxidation and other thermal processes can be minimized, and color purity can be maintained constantly on respective points of the panel in displaying. Also, the processing time can be reduced less than that of the conventional sintering process as much as the difference of sintering temperatures. Also, there is no need to install the tube on the panel as in the conventional sintering method, and therefore, the process becomes simple and the processing time can be reduced. In addition, the organic binder included in the sealant applied on the cap is removed through the sintering process when the cap is fabricated, and therefore, the contamination of the electrodes formed on the lower glass substrate can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for sealing a cap in a field emission display (FED) comprising:

a step of locating a cap, on which a sealant is applied, on a substrate of a panel on which a hole is formed in a vacuum chamber; and a step of hardening the sealant of the cap by irradiating laser in order to cover the hole.

2. The method of claim 1, wherein the panel is exhausted to be a predetermined Torr by a vacuum pump in the vacuum chamber.

3. The method of claim 2, wherein the vacuumed state is formed to be $10^{-7}$ Torr.

4. The method of claim 1, wherein frit glass is used as the sealant, and the frit glass is formed by mixing glass powder and binder with more than 10:1 mass ratio.

5. The method of claim 1 further comprising:

a step of forming a sealing application unit by applying the sealant on a frame;

a step of aligning an upper substrate and a lower substrate as taking the sealing application unit therebetween; and a step of moving the upper substrate, the lower substrate and the sealing application unit into the vacuum chamber.

6. The method of claim 5, wherein the frame uses a material having same coefficient of thermal expansion as those of the upper substrate and the lower substrate.

7. The method of claim 5, wherein the sealing application unit is made by applying respective sealant on upper and lower parts of the frame in a screen printing method.

8. The method of claim 1, wherein the cap has a bottom surface on which the sealant is applied and is formed to cover the hole of the panel.

9. The method of claim 8, wherein the cap is located to cover the hole on the lower glass substrate of the panel by a robot arm.

10. The method of claim 1, wherein the cap is same material as those of the upper and lower substrates.

11. The method of claim 1, wherein the cap is a glass material having a coefficient of thermal expansion which is little different from those of the upper and lower substrates.

12. The method of claim 1, wherein reference temperature is maintained to be 200~350° C. in the sealant hardening process.

13. The method of claim 1, wherein the cap is compressed by a predetermined pressure so that a height of the cap can be maintained constantly when laser is irradiated onto the sealant of the cap.

14. The method of claim 1, wherein a predetermined pressure is compressed on the panel using a gap reference frame in case that the height of the sealant is changed since the sealant of the cap is melted when the laser is irradiated.

15. The method of claim 1, wherein the panel comprises:

a plurality of spacers supporting the upper glass substrate and the lower glass substrate; and a sealant for attaching the spacers and the upper and lower glass substrates.

16. The method of claim 1, wherein the panel includes auxiliary jig for maintaining a distance between the upper glass substrate and the lower glass substrate constantly.

17. A method for fabricating a cap in an FED comprising:

a step of applying sealant on a substrate of glass material;

a step of sintering the substrate of glass material on which the sealant is applied; and a step of cutting the substrate of the glass material on which the sealant is applied.

18. The method of claim 17, wherein the substrate of glass material on which the sealant is applied is sintered under 300~400° C. temperature to remove organic binder component included in the sealant.

19. The method of claim 17, wherein the sealant is applied to be a few $\mu$m~hundreds of $\mu$m thickness.

20. The method of claim 17, wherein the sealant is applied to be a circular shape on the substrate of glass material using a screen printing method, and is not applied on a center of the substrate of glass material.

* * * * *